US006355212B1

(12) United States Patent
Antolotti

(10) Patent No.: US 6,355,212 B1
(45) Date of Patent: Mar. 12, 2002

(54) ALLOY FOR CORROSION-RESISTANT COATINGS OR SURFACE COATINGS

(75) Inventor: Nelso Antolotti, Rubbiano di Solignano (IT)

(73) Assignee: Turbocoating SpA, Solignano (IT)

( * ) Notice: Subject to any disclaimer, the term of this patent is extended or adjusted under 35 U.S.C. 154(b) by 0 days.

(21) Appl. No.: 09/462,272

(22) PCT Filed: Jun. 19, 1998

(86) PCT No.: PCT/IT98/00167

§ 371 Date: Jan. 5, 2000

§ 102(e) Date: Jan. 5, 2000

(87) PCT Pub. No.: WO99/02745

PCT Pub. Date: Jan. 21, 1999

(30) Foreign Application Priority Data

Jul. 10, 1997 (IT) ..... PR97A039

(51) Int. Cl.[7] ..... C22C 38/18

(52) U.S. Cl. ..... 420/34; 420/36; 420/40; 420/41; 420/43; 420/50; 420/51; 420/54; 420/62; 420/70; 420/78; 420/79; 420/80; 420/84; 420/95; 420/97; 420/98; 420/117; 420/119; 420/127; 420/437; 420/440; 420/443; 420/445; 420/452; 420/459; 420/460; 420/583; 420/584.1; 420/585; 420/588; 428/678; 428/937

(58) Field of Search ..... 428/678, 637, 428/937; 420/34, 36, 40, 41, 43, 50, 51, 54, 62, 70, 78, 79, 80, 84, 95, 97, 98, 117, 119, 127, 437, 440, 443, 445, 452, 459, 460, 583, 584.1, 585, 588

(56) References Cited

U.S. PATENT DOCUMENTS

| | | | | | |
|---|---|---|---|---|---|
| 4,124,737 | A | * | 11/1978 | Wolfla et al. | 428/937 |
| 4,503,122 | A | | 3/1985 | Nicoll | 428/678 |
| 4,585,481 | A | | 4/1986 | Gupta et al. | 428/678 |
| 4,743,514 | A | * | 5/1988 | Strangman et al. | 428/678 |
| 5,536,022 | A | * | 7/1996 | Silco et al. | 428/937 |

FOREIGN PATENT DOCUMENTS

| | | |
|---|---|---|
| DE | 38 42 300 | 6/1990 |
| RU | 2 051 196 | 12/1995 |
| WO | WO 96/ 12049 | 4/1996 |

* cited by examiner

*Primary Examiner*—Robert R. Koehler
(74) *Attorney, Agent, or Firm*—Darby & Darby

(57) ABSTRACT

The invention is directed to anti-corrosive alloys and relates in particular to an alloy containing cobalt, chromium, aluminum, yttrium, silicon, a metal from the second main group, together with the corresponding oxide, in the following proportions:

chromium (Cr) 26.0–30%; aluminum (Al) 5.5–13.0%; yttrium (Y) 0.3–1.5%; silicon (Si) 1.5–4.5%; metal from the second main group (magnesium, calcium, barium, strontium) 0.1–2.0%; oxide of the corresponding metal from the second main group 0.1–2.0%; cobalt (Co) remaining percentage.

Preferably, tantalum (Ta) is also added in a proportion of 0.5–4.0%, and the remaining percentage of cobalt is replaced by a remaining percentage of Me, Me being understood to mean a metal which may be nickel (Ni) or iron (Fe) or cobalt (Co) or a composition comprising Ni—Fe—Co, Ni—Fe, Ni—Co, Co—Fe.

6 Claims, No Drawings

ALLOY FOR CORROSION-RESISTANT COATINGS OR SURFACE COATINGS

DESCRIPTION

The present invention relates to an alloy for anti-corrosive coatings or surface coatings which are resistant up to 1100° C.

Such surface coatings can be obtained by the following thermal spraying methods: plasma spraying in vacuo, plasma spraying in air, HVOF (High-Velocity Oxygen Fuel) or high-velocity oxygen flame.

In the field of metallurgy, and in particular in the field of alloys used as coatings for gas turbines against corrosion caused by sulpho-oxidation, an alloy based on cobalt and also containing chromium, aluminium and yttrium in the following proportions:

| | | |
|---|---|---|
| Chromium | (Cr) | 8.0–30.0% |
| Aluminium | (Al) | 5.0–15.0% |
| Yttrium | (Y) | 0–1.0% |
| Cobalt | (Co) | remaining percentage |

is already known.

Said alloy is resistant to corrosion and guarantees a service life of 1000 hours if used for the coating of components which operate in the presence of sodium-, vanadium-, sulphlur- and chlorine-containing hydrocarbon combustion products.

A first disadvantage is that this alloy does not guarantee sufficient corrosion resistance if employed at temperatures above 700° C.

Furthermore, if said alloy is applied by a thermal spraying method (APS, VPS, HVOF), oxidation of yttrium and aluminium occurs, thus resulting in the loss of the working property of the coating.

A second alloy based on cobalt and containing chromium, aluminium, yttrium and silicon in the following proportions:

| | | |
|---|---|---|
| Chromium | (Cr) | 12.5–20.0% |
| Aluminium | (Al) | 2.0–8.0% |
| Yttrium | (Y) | 0–0.25% |
| Silicon | (Si) | 2.0–6.0% |
| Cobalt | (Co) | remaining percentage |

is also known

Said second alloy is used for coating components with a superalloy material. The presence of silicon in the coating matrix provides resistance against the formation of oxides and sulphides on the surface layer.

However, this second alloy has a low yttrium content, which is insufficient for ensuring corrosion resistance in the presence of products containing substantial amounts of sulphur, chlorine and vanadium.

A third alloy is known from U.S. Pat. No. 4,585,481, which describes an alloy based on cobalt and containing chromium, aluminium, yttrium and silicon in the following proportions:

| | | |
|---|---|---|
| Chromium | (Cr) | 5.0–40.0% |
| Aluminium | (Al) | 8.0–35.0% |
| Yttrium | (Y) | 0.1–2.0% |

-continued

| | | |
|---|---|---|
| Silicon | (Si) | 0.1–7.0% |
| Cobalt | (Co) | remaining percentage. |

However, this alloy results in a reduction of the plasticity of the coating, making it impossible to use it for the coating of apparatuses or objects which must withstand substantial changes in temperature.

A further disadvantage is that, during application of the coating or surface coating by the plasma method, oxidation of yttrium and silicon may take place.

This third alloy is unable to guarantee the corrosion resistance required in the presence of combustion products containing substantial amounts of sulphur, chlorine and vanadium.

The alloys mentioned above can usually be used at temperatures not exceeding 900° C., since all of them are based on cobalt.

RU-A-2051196 teaches an alloy for corrosion-resistant coatings or surface coatings, containing of cobalt, chromium, aluminium, yttrium, silicon, and a metal from the second main group, together with the corresponding oxide, in the following proportions:

| | | |
|---|---|---|
| Chromium | (Cr) | 26.0–30.0% |
| Aluminium | (Al) | 6.0–8.0% |
| Yttrium | (Y) | 0.3–1.5% |
| Silicon | (Si) | 1.5–4.5% |
| Metal from the second main group (magnesium, calcium, barium, strontium) | | 0.1–0.5% |
| Oxide of the corresponding metal from the second main group | | 0.1–1.0% |
| Cobalt | (Co) | remaining percentage. |

This alloy resists only up to 800° C.

The object of the present invention is to eliminate the abovementioned disadvantages and provide an alloy with excellent performance even at high temperatures, in particular even above 1000° C.

Said objects are fully achieved by the alloy, according to the present invention, for corrosion-resistant coatings or surface coatings.

After numerous studies, the Applicant has realized that the disadvantages of the known alloys based on cobalt and containing chromium, aluminium, yttrium and silicon can be avoided by adding one of the metals from the second main group (magnesium, calcium, barium, strontium), both in free form and in the form of the oxide, in the abovementioned proportions.

The present invention relates to a modified alloy in which the components are present in the following proportions in weight:

| | | |
|---|---|---|
| Chromium | (Cr) | 22.0–30.0% |
| Aluminium | (Al) | 5.5–13.0% |
| Yttrium | (Y) | 0.3–1.5% |
| Silicon | (Si) | 1.5–4.5% |
| Metal from the second main group (Mg, Ca, Ba, Sr) | | 0.1–2.0% |
| Oxide of the corresponding metal (Mg, Ca, Ba, Sr) from the second main group with the addition of | | 0.1–2.0% |

-continued

| | | |
|---|---|---|
| Tantalum | (Ta) | 0.5–4.0% |
| Me | | remaining percentage in weight |

in which Me is a metal which can be nickel (Ni) or iron (Fe) or cobalt (Co) or a composition comprising Ni—Fe—Co, Ni—Co, Ni—Fe, Fe—Co.

Together with tantalum or in its place, rhenium (Re) may also be present in a percentage of2.0–11.0%.

This characteristic feature, along with others, will become more apparent from the following description of a few preferred embodiments which are described by way of nonlimiting examples.

The alloy according to the present invention is an alloy for anti-corrosive surface coatings which is based on cobalt and contains chromium, aluminium, yttrium, silicon, and a metal from the second main group, together with the corresponding oxide, in the following proportions:

| | | |
|---|---|---|
| Chromium | (Cr) | 26.0–30.0% |
| Aluminium | (Al) | 6.0–8.0% |
| Yttrium | (Y) | 0.3–1.5% |
| Silicon | (Si) | 1.5–4.5% |
| Metal from the second main group (magnesium, calcium, barium, strontium) | | 0.1–0.5% |
| Oxide of the corresponding metal from the second main group | | 0.1–1.0% |
| Cobalt | (Co) | remaining percentage. |

The addition of one of the metals from the second main group (magnesium, calcium, barium, strontium), both in free form and in the form of the oxide, in the abovementioned proportions, does indeed avoid the disadvantages of the cobalt-based alloys of the prior art.

After numerous tests and studies, the Applicant has furthermore developed a second alloy directly derived from the one described above.

Indeed, the second alloy differs from the preceding one mainly by:

the addition of a new element, i.e. tantalum, the replacement of cobalt by nickel or iron or by cobalt-nickel-iron, nickel-iron, iron-cobalt or nickel-cobalt alloys, and, to a lesser extent, by different percentages of other elements in the following proportions:

| | | |
|---|---|---|
| Chromium | (Cr) | 22.0–31.0% |
| Aluminium | (Al) | 5.5–13.0% |
| Yttrium | (Y) | 0.3–1.5% |
| Silicon | (Si) | 1.5–10.0% |
| Metal from the second main group (Mg, Ca, Ba, Sr) | | 0.1–2.0% |
| Oxide of the corresponding metal (Mg, Ca, Ba, Sr) from the second main group | | 0.1–2.0% |
| Tantalum | (Ta) | 0.5–4.0% |
| Me | | remaining percentage |

where Me denotes a metal which can be nickel (Ni) or iron (Fe) or cobalt (Co) or a composition comprising Ni—Fe—Co.

Moreover, according to a second variant, in addition to tantalum or in place of tantalum, rhenium (Re) is envisaged as being present in a percentage of 2.0–1.0.

The predominant presence of the metal denoted by Me and the content of chromium and aluminium in the percentages given ensure that the coating obtained exhibits a base and two phases: the γ-phase matrix on top of an Me—Cr base and the free Me—Al β-phase.

The presence of aluminium on the surface of the coating in the abovementioned percentage results in the formation of a protective $Al_2O_3$ layer which gives the coating obtained improved corrosion resistance.

The presence of yttrium in the proportions mentioned prevents the coating from developing cracks and from flaking.

Moreover, the Applicant has found that replacing yttrium (Y) by an yttrium/hafnium (Y/Hf) composition having the same percentage (0.3–1.5%), relative to the total of the components, achieves better adhesion of the alumina, $Al_2O_3$, to the surface of the coating.

The presence of silicon and of a metal from the second main group in free form and in the form of the oxide in the proportions mentioned increases the corrosion resistance of the γ-matrix of the surface of the coating obtained on the article which operates in a temperature range of between 700° C. and 850° C.

The combination of silicon with the metal from the second main group and its oxide makes it possible to maintain the operational capacity of the surface coating obtained when applied by plasma spraying in air or by high-velocity flame spraying.

The presence of the metal from the second main group (Mg, Ca, Ba, Sr) in the proportions mentioned prevents the yttrium and silicon from being oxidized during application of the coating or surface coating.

A lower content of silicon, of the metal from the second main group and its oxide in the alloy based on nickel, iron and cobalt according to the present invention does not increase the corrosion resistance of the coating.

A higher content of silicon, yttrium, metal from the second main group and its oxide in the alloy according to the present invention produces a deterioration in the mechanical characteristics of the coating obtained, increases the fragility, reduces the coefficient of thermal expansion, and thus causes the coating to form cracks and to flake and therefore lowers the protection with respect to corrosion caused by sulpho-oxidation.

Increasing the content of the oxide of the metal from the second main group, relative to the abovementioned percentages, ensures that the effect that the corrosion-promoting components present in the fuel ($Na_2SO_4$ and $V_2O_5$) have on the coating is diminished owing to the formation of thermodynamically stable sulphates and vanadates. The addition of tantalum and/or rhenium furthermore results in a significantly improved performance at oxidation temperature levels above temperatures of 1000° C.

What is claimed is:

1. Alloy for corrosion-resistant coatings or surface coatings, based upon chromium, aluminum, yttrium, silicon, and a metal from the second main group, together with the corresponding oxide, tantalum and one or more metals from Ni, Fe and Co, in the following proportions in weight:

| | | |
|---|---|---|
| Chromium | (Cr) | 22.0–31.0% |
| Aluminium | (Al) | 5.5–13.0% |
| Yttrium + Hafnium composition | (Y + Hf) | 0.3–1.5% |
| Silicon | (Si) | 1.5–10.0% |
| Metal from the second main group (Mg, Ca, Ba, Sr) | | 0.1–2.0% |
| Oxide of the corresponding metal | | |

-continued

| | | |
|---|---|---|
| (Mg, Ca, Ba, Sr) from the second main group wherein there is the addition of | | 0.1–2.0% |
| Tantalum and/or | (Ta) | 0.5–4.0% |
| Rhenium | (Re) | 2.0–11.0% |
| Me | | remaining percentage in weight |

where Me is a metal which can be nickel (Ni) or iron (Fe) or cobalt (Co) or a composition comprising Ni—Fe—Co, Ni—Fe, Ni—Co, Fe—Co.

2. Alloy according to claim 1, wherein the percentage in weight of Silicon is 4.5–10.0%.

3. Alloy according to claim 1, wherein the percentage in weight of Metal from the second main group (Mg, Ca, Ba, Sr) is 0.6–2.0%.

4. Alloy according to claim 1, wherein the percentage in weight of Oxide of the corresponding metal (Mg, Ca, Ba, Sr) is 1.1–2.0%.

5. Alloy according to claim 1, wherein the alloy can be applied through plasma spraying in air (APS) or in vacuum (VPS).

6. Protective anticorrosive coating, characterized in that it is prepared by using an alloy according to claim 1.

* * * * *